US011274836B2

(12) United States Patent
Park et al.

(10) Patent No.: US 11,274,836 B2
(45) Date of Patent: Mar. 15, 2022

(54) AIR CONDITIONER APPARATUS

(71) Applicant: LG ELECTRONICS INC., Seoul (KR)

(72) Inventors: Janghee Park, Seoul (KR); Hansaem Park, Seoul (KR); Yongki Jeong, Seoul (KR); Doyong Ha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 40 days.

(21) Appl. No.: 16/638,228

(22) PCT Filed: Aug. 8, 2018

(86) PCT No.: PCT/KR2018/009011
§ 371 (c)(1),
(2) Date: Feb. 11, 2020

(87) PCT Pub. No.: WO2019/031835
PCT Pub. Date: Feb. 14, 2019

(65) Prior Publication Data

US 2020/0173668 A1 Jun. 4, 2020

(30) Foreign Application Priority Data

Aug. 11, 2017 (KR) ..... 10-2017-0102449

(51) Int. Cl.
*F24F 1/032* (2019.01)
*F24F 11/89* (2018.01)
(Continued)

(52) U.S. Cl.
CPC ..... *F24F 1/032* (2019.02); *F24F 1/028* (2019.02); *F24F 1/037* (2019.02); *F24F 1/0358* (2019.02);
(Continued)

(58) Field of Classification Search
CPC ..... F24F 2013/207; F24F 13/30; F24F 13/20; F24F 13/02; F24F 3/1411; F24F 1/24;
(Continued)

(56) References Cited

U.S. PATENT DOCUMENTS 2,724,247 A * 11/1955 Kurtz ..... F24F 11/30 62/325
6,196,013 B1 3/2001 Kim
(Continued)

FOREIGN PATENT DOCUMENTS

EP 1 739 371 1/2007
EP 2 413 052 2/2012
(Continued)

OTHER PUBLICATIONS

International Search Report dated Jan. 2, 2019 issued in Application No. PCT/KR2018/009011.
(Continued)

*Primary Examiner* — Schyler S Sanks
(74) *Attorney, Agent, or Firm* — Ked & Associates LLP

(57) ABSTRACT

The air conditioner apparatus according to the present invention includes: a case which forms a first common passage, and a second common passage; and a suction guide which is disposed in each of the first common passage and the second common passage, which guides air flown into the case to a first desiccant heat exchanger which is disposed in the first common passage or a second desiccant heat exchanger which is disposed in the second common passage, and which forms a compressor accommodation chamber where a compressor is accommodated, wherein at least two cooling holes for sending some of the air flown into the case to the compressor accommodation chamber and for sending air flowing inside the compressor accommodation chamber
(Continued)

to the first common passage or the second common passage are formed in the suction guide.

10 Claims, 10 Drawing Sheets

(51) Int. Cl.

| | |
|---|---|
| ***F24F 1/0358*** | (2019.01) |
| ***F24F 1/028*** | (2019.01) |
| ***F24F 1/037*** | (2019.01) |
| ***F24F 1/24*** | (2011.01) |
| ***F24F 3/14*** | (2006.01) |
| ***F24F 13/02*** | (2006.01) |
| ***F24F 13/20*** | (2006.01) |
| ***F24F 13/30*** | (2006.01) |

(52) U.S. Cl.
CPC ..... *F24F 1/24* (2013.01); *F24F 3/1411* (2013.01); *F24F 11/89* (2018.01); *F24F 13/02* (2013.01); *F24F 13/20* (2013.01); *F24F 13/30* (2013.01)

(58) Field of Classification Search
CPC ..... F24F 1/037; F24F 1/0358; F24F 1/028; F24F 11/89; F24F 1/032
See application file for complete search history.

(56) References Cited

U.S. PATENT DOCUMENTS

| | | | | |
|---|---|---|---|---|
| 2009/0025413 | A1* | 1/2009 | Koga | F24F 1/00 62/259.1 |
| 2010/0218534 | A1* | 9/2010 | Yabu | F24F 13/20 62/271 |
| 2016/0201942 | A1 | 7/2016 | Kwak et al. | |

FOREIGN PATENT DOCUMENTS

| | | |
|---|---|---|
| JP | 2004-360941 | 12/2004 |
| JP | 2015-040679 | 3/2015 |
| KR | 10-2006-0025925 | 3/2006 |
| KR | 10-2013-0042289 | 4/2013 |
| KR | 10-2013-0142259 | 12/2013 |
| KR | 10-2016-0086693 | 7/2016 |

OTHER PUBLICATIONS

Written Opinion dated Jan. 2, 2019 issued in Application No. PCT/KR2018/009011.
European Search Report issued in Application No. 18843476.5 dated Apr. 12, 2021.

* cited by examiner

AIR CONDITIONER APPARATUS

TECHNICAL FIELD

The present invention relates to an air conditioner apparatus and more particularly to an air conditioner apparatus using a desiccant heat exchanger.

BACKGROUND ART

In general, an air conditioner apparatus refers to an apparatus that cools or heats indoor air by making the indoor air circulate.

An air conditioner apparatus provided without a ventilation function cools or heats indoor air by making only the indoor air circulate. In the case of performing air conditioning only with the indoor air, the quality of the indoor air deteriorates slowly.

Recently, air conditioner apparatuses provided with a ventilation function to suction outdoor air and discharge indoor air are being increasingly installed. In addition, a heat exchanger in which a refrigerant circulates through a compressor is desiccant-coated for humidification or dehumidification.

However, such a compressor may be disposed inside an air conditioner apparatus, and, if the compressor disposed inside the air conditioner apparatus is not cooled appropriately, the compressor may become overheated which could shorten the lifetime of the compressor or reduce operating efficiency of the compressor.

In addition, even a control device for controlling configurations of the air conditioner apparatus may become overheated during electrical operation, and, if the control device is not cooled appropriately, an operation error may occur in the air conditioner apparatus.

To cool heat generated by the control device, a control box for accommodating the control device may be installed external to the air conditioner apparatus and a hole may be formed in an external surface of the air conditioner apparatus so that the heat generated by the control device may be cooled. In this case, however, there are problems that the control device is exposed to an outside and that a fire may brake out because of dust and insect remains coming from the outside.

DISCLOSURE

Technical Problem

An object of the present invention is to provide an air conditioner apparatus which removes heat, generated in a compressor due to operation of the compressor, so as to preserve the lifetime of the compressor.

Another object of the present invention is to provide an air conditioner apparatus which is capable of preventing an operation error from occurring from overheat of a control device, while not being exposed to an outside.

Objects of the present invention are not limited to the aforementioned objects, and other objects, which are not mentioned above, will be apparent to a person having ordinary skill in the art from the following description.

Technical Solution

In order to achieve the above object, an air conditioner apparatus according to the present invention includes: a case which forms a first common passage and a second common passage; indoor and outdoor discharge fans which discharges air to an indoor space and an outdoor space; first and second desiccant heat exchangers which are respectively disposed in the first common passage and the second common passage; a compressor; and a suction guide which guides air flowing inside the case to a heat exchanger and which forms a compressor accommodation chamber where the compressor is accommodated, wherein a cooling hole is formed in the suction guide so as to send some of air flown into the case to the compressor accommodation chamber so that some of the air flowing inside the case flows to the compressor accommodation chamber to cool the compressor.

An indoor suction chamber and an outdoor suction chamber may be formed inside the case and connected to the first common passage and the second common passage, and the suction guide may be classified into a first guide surface having a first cooling hole formed therein and a second guide surface having a second cooling hole formed therein, so that some of air flowing along the first guide surface or the second guide surface is capable of flowing into the compressor accommodation chamber through the first cooling hole or the second cooling hole.

The air conditioner apparatus according to the present invention may further include a control box which accommodates a control device and which is disposed external to the case, and a communication hole for sending air flowing inside the case to the control box is formed on one surface of the case on which the control box is disposed, so that some of the air flowing inside the case is capable of flowing into the control box.

The control box may be disposed external to the case in which the compressor accommodation space is formed, and the communication hole may communicate the compressor accommodation chamber and an inside of the control box with each other, so that some of air flowing inside the compressor accommodation chamber is capable of flowing into the control box.

The suction guide may have a discharge hole formed therein for sending air flown into the compressor accommodation chamber to the first desiccant heat exchanger or the second desiccant heat exchanger, so that air flown into the compressor accommodation chamber is discharged to the desiccant heat exchangers.

The air conditioner apparatus according to the present invention may further include a one-way valve disposed at the cooling hole of the suction guide to make a flow direction of air communicating through the cooling hole to be a one-way direction, so that air flown into the case flows to the compressor accommodation chamber and air backflow is prevented.

An indoor suction chamber and an outdoor suction chamber may be formed inside the case, and the suction guide may include a first guide surface having a first cooling hole formed therein, a second guide surface having a second cooling hole formed therein, and a central guide surface having a discharge hole formed therein, so that indoor or outdoor air is sent to the desiccant heat exchangers through the compressor accommodation chamber and air backflow is prevented.

A first one-way valve for making a flow direction of air flowing through the first cooling hole to be a one-way direction may be formed in the first guide surface, a second one-way vale for making a flow direction of air flowing through the second cooling hole to be a one-way direction may be formed in the second guide surface, and the first one-way valve and the second one-way valve may be rotated inward of the compressor accommodation chamber to thereby send indoor or outdoor air to the desiccant heat exchangers through the compressor accommodation chamber and prevent air backflow.

The details of other embodiments are included in the following description and the accompanying drawings.

Advantageous Effects

An air conditioner apparatus of the present invention have one or more effects as follows.

First, as a compressor is cooled using air flowing inside in a case, the compressor may not become overheated and thus operating efficiency of the compressor may be maximized.

Second, it is possible to cool a control device, which is not exposed to an outside, using air flowing inside the case, and thus, occurrence of an error due to overheat of the control device may be minimized.

Third, it is possible to prevent air from backflowing inside the case and maximize an amount of air flowing to a desiccant heat exchanger to ventilate an indoor space.

The effects of the present invention are not limited to the aforementioned effect, and other effects, which are not mentioned above, will be apparent to a person having ordinary skill in the art from description of claims.

BEST MODE

Figure 1:
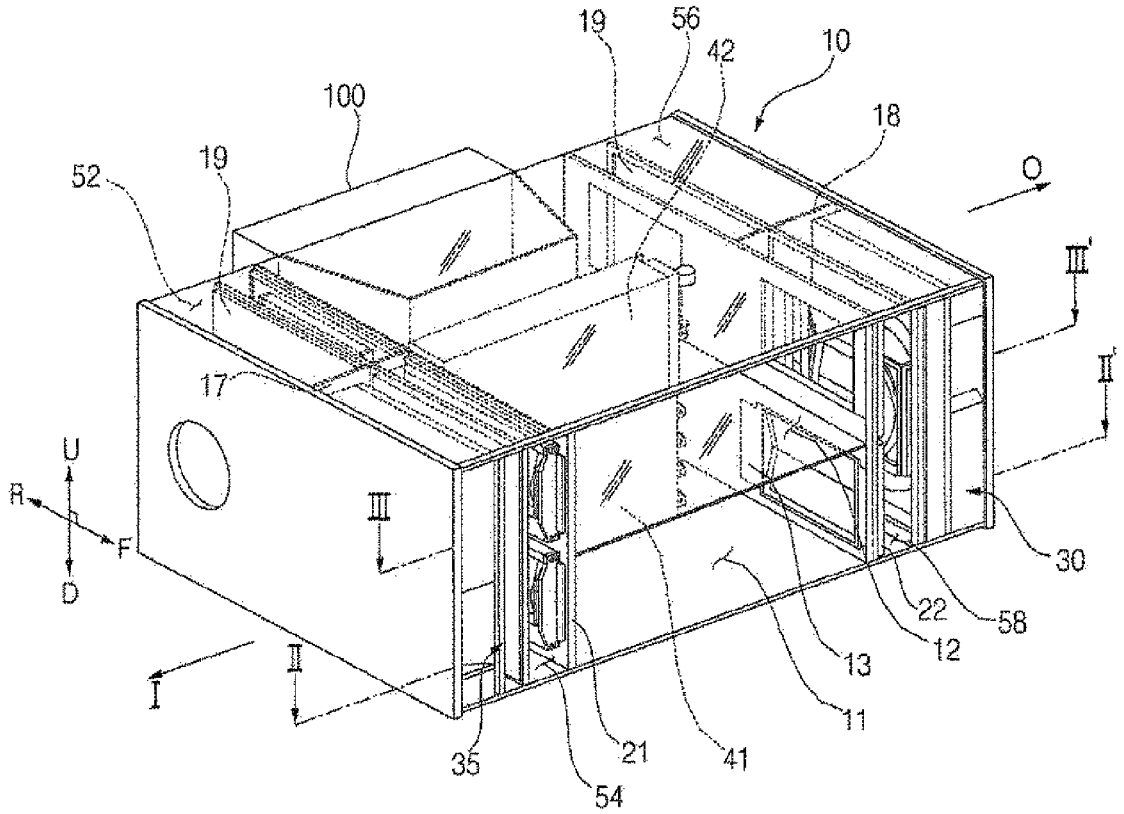
FIG. 1 is a perspective view of an air conditioner apparatus according to an embodiment of the present invention.

Advantages and features of the present invention and a method of achieving the same will be clearly understood from embodiments described below in detail with reference to the accompanying drawings. However, the present invention is not limited to the following embodiments and may be implemented in various different forms. The embodiments are provided merely for complete disclosure of the present invention and to fully convey the scope of the invention to those of ordinary skill in the art to which the present invention pertains. The present invention is defined only by the scope of the claims. In the drawings, the thickness of layers and regions may be exaggerated for clarity. Throughout the drawings, like numbers refer to like elements.

The terms "forward (F)/rearward (R)/upward (U)/downward (D)/indoor (I)/outdoor (O)" mentioned in the following description are defined as shown in the drawings. However, the terms are used merely to clearly understand the present invention, and therefore the above-mentioned directions may be differently defined.

Hereinafter, the present invention will be described with reference to the drawings illustrating an air conditioner apparatus according to embodiments of the present invention.

Figure 2:
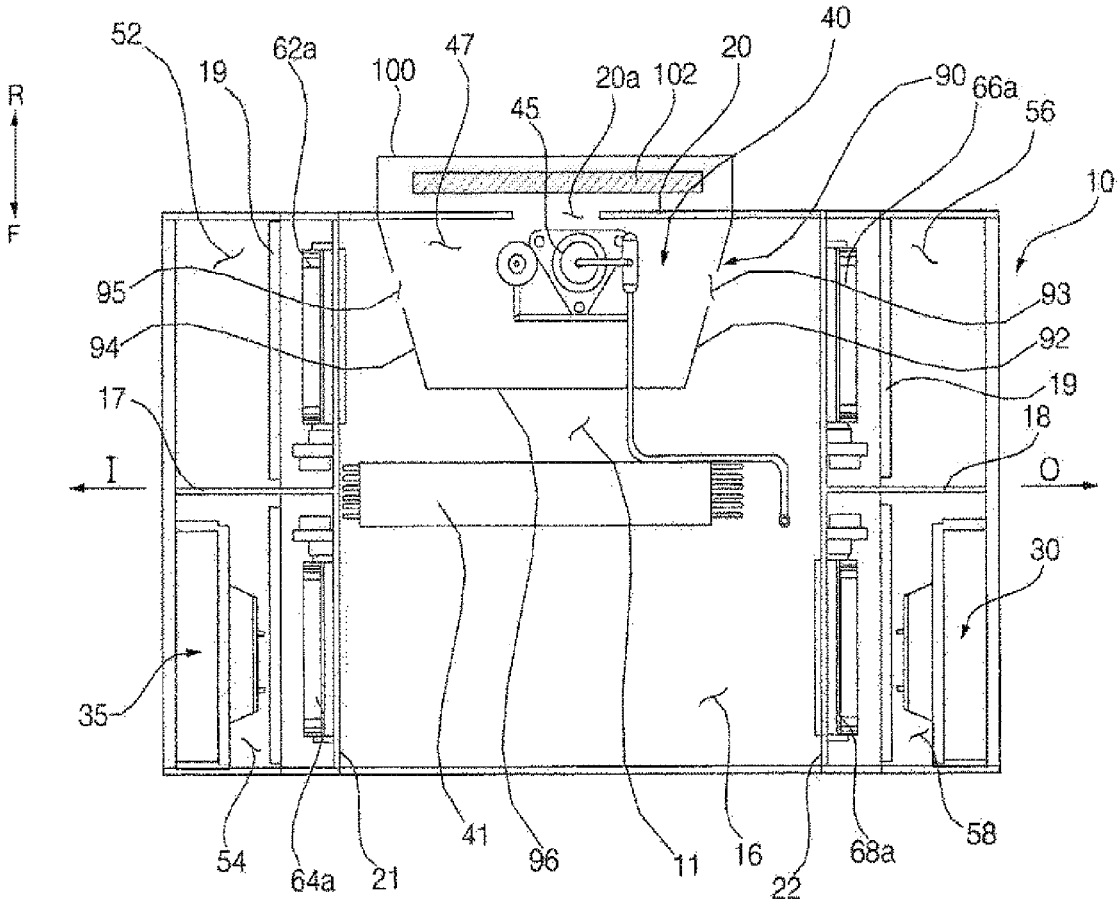
FIG. 2 is a cross-sectional view taken along the line II-II' shown in FIG. 1.
Figure 3:
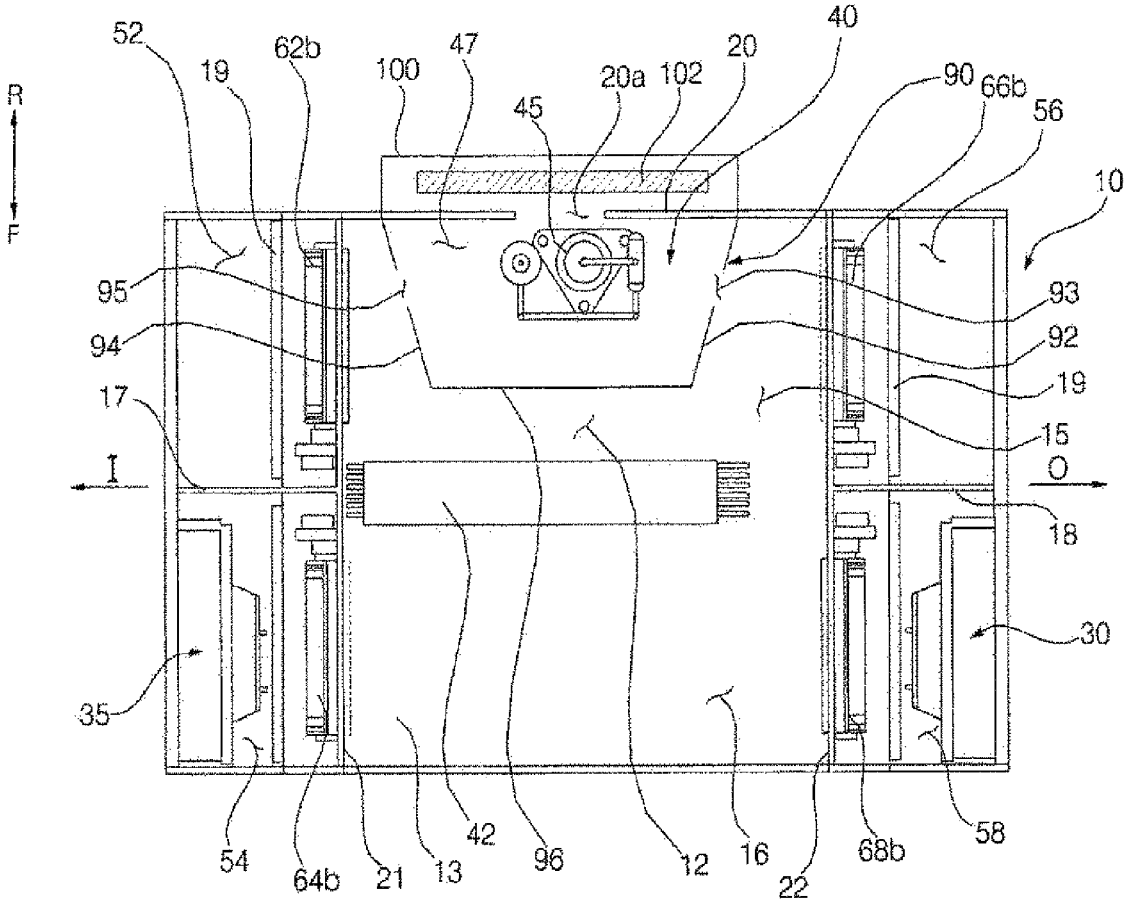
FIG. 3 is a cross-sectional view taken along the line III-III' shown in FIG. 1.
Figure 4:
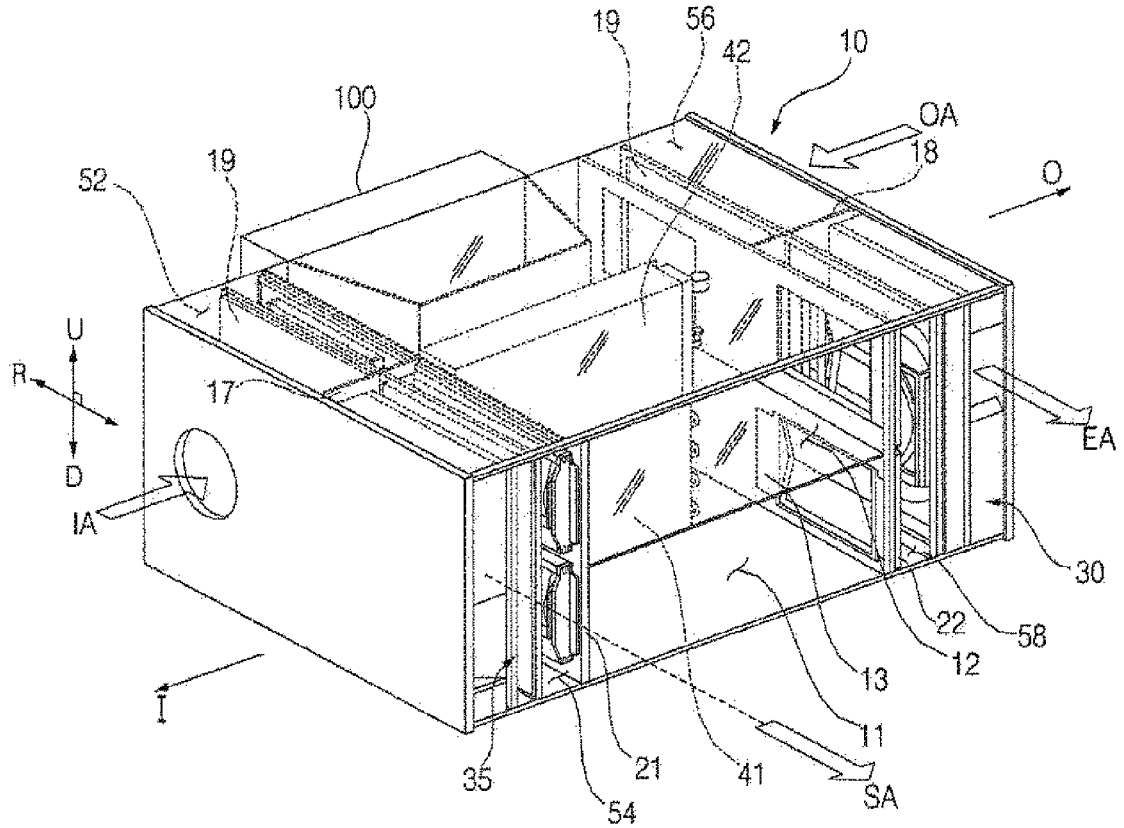
FIG. 4 is a diagram illustrating an air flow in an air conditioner apparatus according to an embodiment of the present invention.

FIG. 1 is a perspective view of an air conditioner apparatus according to an embodiment of the present invention. FIG. 2 is a cross-sectional view taken along the line II-II ' shown in FIG. 1. FIG. 3 is a cross-sectional view taken along the line III-III' shown in FIG. 1. FIG. 4 is a diagram illustrating an air flow in an air conditioner apparatus according to an embodiment of the present invention.

Hereinafter, an example of an air conditioner according to the present invention will be described in detail with reference to FIGS. 1 to 4.

Referring to FIGS. 1 and 2, an air conditioner apparatus according to an embodiment of the present invention includes: a case 10 forming an exterior; an outdoor discharge fan 30 installed at the case 10 and discharging air to an outdoor space; an indoor discharge fan 35 installed at the case 10 and discharging air to an indoor space; and an air conditioning unit 40 installed at the case 10 and performing air conditioning on an air flow.

In the case 10, there are formed a first common passage 11 through which indoor air or outdoor air flows, and a second common passage 12 which is positioned above the first common passage 11 and through which indoor air or outdoor air flows. In the case 10 according to this embodiment, there are formed an indoor suction chamber 52 which is connected to the first common passage 11 and the second common passage 12 and into which indoor air is suctioned, and an indoor discharge chamber 54 which is connected to the first common passage 11 and the second common passage 12 and through which air is discharged to an inner space. In addition, in the case 10 according to this embodiment, there are formed an outdoor suction chamber 56 which is connected to the first common passage 11 and the second common passage 12 and into which outdoor air is suctioned, and an outdoor discharge chamber 58 which is connected to the first common passage 11 and the second common passage 12 and through which air is discharged to an outdoor space.

The indoor discharge fan 35 is disposed in the indoor discharge chamber 54, and the outdoor discharge fan 30 is disposed in the outdoor discharge chamber 58. With reference to FIGS. 2 and 3, the indoor discharge chamber 54 and the indoor suction chamber 52 are disposed on one side of the first common passage 11 and the second common passage 12. In addition, the outdoor discharge chamber 58 and the outdoor suction chamber 56 are disposed on the other side of the first common passage 11 and the second common passage 12. That is, the first common passage 11 and the second common passage 12 are disposed between the indoor discharge chamber 54 and the indoor suction chamber 52 and between the outdoor discharge chamber 58 and the outdoor suction chamber 56.

Referring to FIGS. 1 to 4, the suction chambers 52 and 56 according to this embodiment are disposed at the rear (R) of the discharge chambers 54 and 58. Thus, air is suctioned into the suction chambers 52 and 56 disposed at the rear (R), and then discharged to the discharge chambers 54 and 58 disposed at the front (F).

The case 10 according to this embodiment may have a shape of a rectangular parallelepiped. The case 10 of this embodiment is formed to have a width greater than a height so that the case 10 can be installed at a ceiling.

In the following description, for convenience of explanation, introducing indoor air into the case 10 through the indoor suction chamber 52 is referred to as "ventilating (IA)", and discharging air inside the case 10 to an indoor space through the indoor discharge chamber 54 is referred to as "supplying (SA)". In addition, introducing outdoor air into the case 10 through the outdoor suction chamber 56 is referred to as "intaking (OA)", and discharging air inside the case 10 to an outdoor space through the outdoor discharge chamber 58 may be called "exhausting (EA)".

The first common passage 11 and the second common passage 12 are formed inside the case 10, and separated by an upper and lower side separating plate 13. In the air conditioner apparatus according to this embodiment, the first common passage 11 may be formed under the upper and lower side separating plate 13 and the second common passage 12 may be formed above the upper and lower side separating plate 13. In the case 10, the first common passage 11 and the second common passage 12 are formed between a first partition 21 and a second partition 22 which will be described later.

The air conditioner apparatus according to this embodiment further includes a suction guide 90 which guides air suctioned into the indoor suction chamber 52 and the outdoor suction chamber 56 to desiccant heat exchangers 41 and 42. The suction guide 90 is disposed in each of the first common passage 11 and the second common passage 12.

In the indoor suction chamber 52, there may be an indoor suction dampers 62*a* or 62*b* for controlling air flow with the first common passage 11 or the second common passage 12. In the indoor discharge chamber 54, there may be an indoor discharge damper 64*a* or 64*b* for controlling air flow with the first common passage 11 or the second common passage 12. In the outdoor suction chamber 56, there may be an outdoor suction damper 66*a* or 66*b* for controlling air flow with the first common passage 11 or the second common passage 12. In the outdoor discharge chamber 58, there may be an outdoor discharge damper 68 for controlling air flow with the first common passage 11 or the second common passage 12.

The plurality of dampers described above may be eight dampers which are respectively provided in four chambers of each of the first common passage 11 and the second common passage 12.

The air conditioner apparatus according to this embodiment may include a partition which separates the inside of the case 10 to form the above-described chambers. The partition may include the first partition 21 for separating the indoor suction chamber 52 and the indoor discharge chamber 54 and for separating the first common passage 11 and the second common passage 12, and the second partition 22 for separating the outdoor suction chamber 56 and the outdoor discharge chamber 58 and for separating the first common passage 11 and the second common passage 12.

The first partition 21 has four openings formed therein. The first indoor suction damper 62*a*, the second indoor suction damper 62*b*, the first discharge damper 64*a*, and the second indoor discharge damper 64*b* are mounted to the respective openings of the first partition 21. The first indoor suction damper 62*a* and the first indoor discharge damper 64*a* are disposed at the first partition 21 in one side to the first common passage 11. The second indoor suction damper 62*b* and the second indoor discharge damper 64*b* are disposed at the first partition 21 in one side to the second common passage 12.

The second partition 22 has four openings formed therein. The first outdoor suction damper 66*a*, the second outdoor suction damper 66*b*, the first outdoor discharge damper 68*a*, and the second outdoor discharge damper 68*b* are mounted to the respective openings of the second partition 22. The first outdoor suction chamber 66*a* and the first outdoor discharge damper 68*a* are disposed at the second partition 22 in the other side of the first common passage 11. The second outdoor suction damper 66*b* and the second outdoor discharge damper 68*b* are disposed at the second partition 22 in the other side of the second common passage 12.

In addition, the partition may further include a third partition 17 for separating the indoor suction chamber 52 and the indoor discharge chamber 54, and a fourth partition 18 for separating the outdoor suction chamber 56 and the outdoor discharge chamber 58. Air ventilated (IA) to the indoor suction chamber 52 is not supplied (SA) directly to the indoor discharge chamber 54 but instead moves to the first common passage 11 or the second common passage 12 due to the presence of the third partition 17. Air intake (OA) into the outdoor suction chamber 56 is not exhausted (EA) directly to the outdoor discharge chamber 58 but instead to the first common passage 11 or the second common passage 12 due to the presence of the fourth partition 18.

The air conditioning unit 40 according to this embodiment may include a compressor 45, the desiccant heat exchangers 41 and 42 respectively provided in the first common passage 11 and the second common passage 12, an expansion valve 43, and a refrigerant switching valve 44.

Surfaces of the desiccant heat exchangers 41 and 42 are desiccant-coated to absorb moisture in the air. The desiccant coating is of a material capable of absorbing moisture in the air and dissipating the absorbed moisture into the air upon application of heat, and such a material is generally used by a person skilled in the art and thus detailed description thereof will be omitted.

The desiccant heat exchangers 41 and 42 according to this embodiment may be divided into a first desiccant heat exchanger 41 arranged in the first common passage 11, and a second desiccant heat exchanger 42 arranged in the second common passage 12.

The first desiccant heat exchanger 41 may be arranged inside the first common passage 11 disposed under the upper and lower side separating plate 13, and the second desiccant heat exchanger 42 may be arranged inside the second common passage 12 disposed above the upper and lower side separating plate 13.

In this case, the air conditioning unit 40 may be a heat pump capable of operating in a cooling cycle and a heating cycle. Thus, when the first desiccant heat exchanger 41 acts as a condenser due to flow path switching by the refrigerant switching valve 44, the second desiccant heat exchanger 42 may act as an evaporator. In addition, when the first desiccant heat exchanger 41 acts as an evaporator, the second desiccant heat exchanger 42 may act as a condenser. The operating mechanism of the air conditioner 40 is a general technology well known for a person skilled in the art, and thus, a detailed description thereof will be omitted.

The first desiccant heat exchanger 41 and the second desiccant heat exchanger 42 may be arranged to separate each of the first common passage 11 and the second common passage 12 into a suction side passage 15 and a discharge side passage 16.

The suction side passage 15 is a space of the first common passage 11 or the second common passage 12 being connected to the indoor suction chamber 52 and the outdoor suction chamber 56. The discharge side passage 16 is a space of the first common passage 11 or the second common passage 12 being connected to the indoor discharge chamber 54 and the outdoor discharge chamber 58.

The air conditioner apparatus according to this embodiment may further include a filter 19 which filters air introduced into the inside of the case 10. The filter 19 according to this embodiment may be arranged in the indoor suction chamber 52 and the outdoor suction chamber 56. In addition, the filter 19 according to this embodiment may be arranged in the indoor discharge chamber 54 or the outdoor discharge chamber 58 so as to filter air discharged to an indoor space or an outdoor space.

FIG. 5 is a schematic view of an airflow according to an operation method of an air conditioner apparatus according to this embodiment.

Figure 5A:
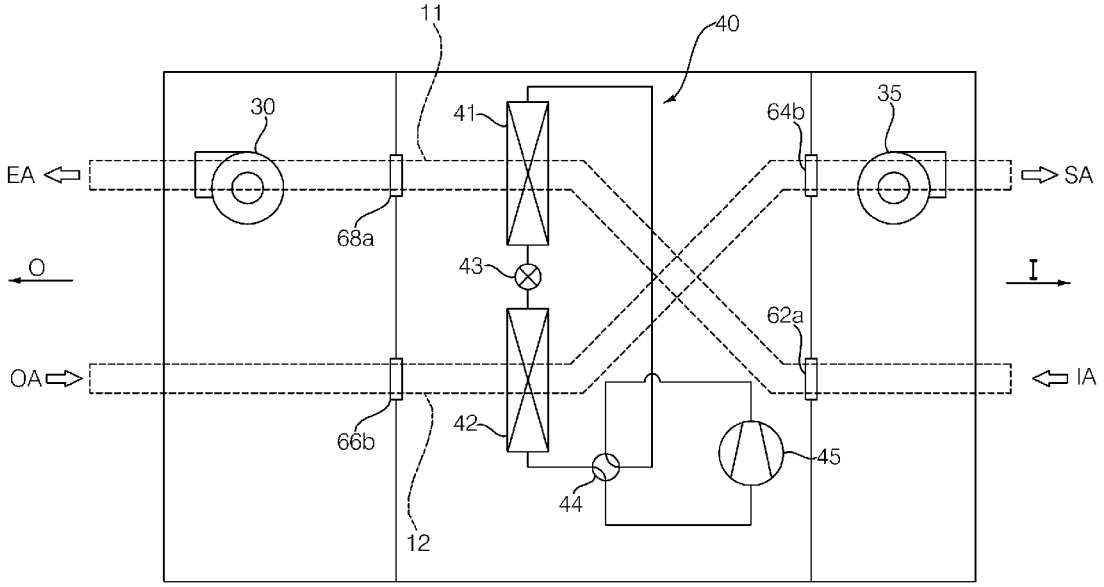
FIG. 5A is a schematic view of an airflow according to an operation method of an air conditioner apparatus according to an embodiment of the present invention.

In FIG. 5A, air intake (OA) into the outdoor suction chamber 56 is supplied (SA) to the indoor discharge chamber 54 through the second common passage 12. In addition, air ventilated (IA) into the indoor suction chamber 52 is exhausted (EA) to the outdoor discharge chamber 58 through the first common passage 11. In this case, in the first common passage 11, the first indoor suction damper 62*a* and the first outdoor discharge damper 68*a* are opened and the first indoor discharge damper 64*a* and the first outdoor suction damper 66*a* are closed. In addition, in the second common passage 12, the second outdoor suction damper 66*b* and the second indoor discharge damper 64*b* are opened and the second outdoor discharge damper 68*b* and the second indoor suction damper 62*b* are closed.

Figure 6A:
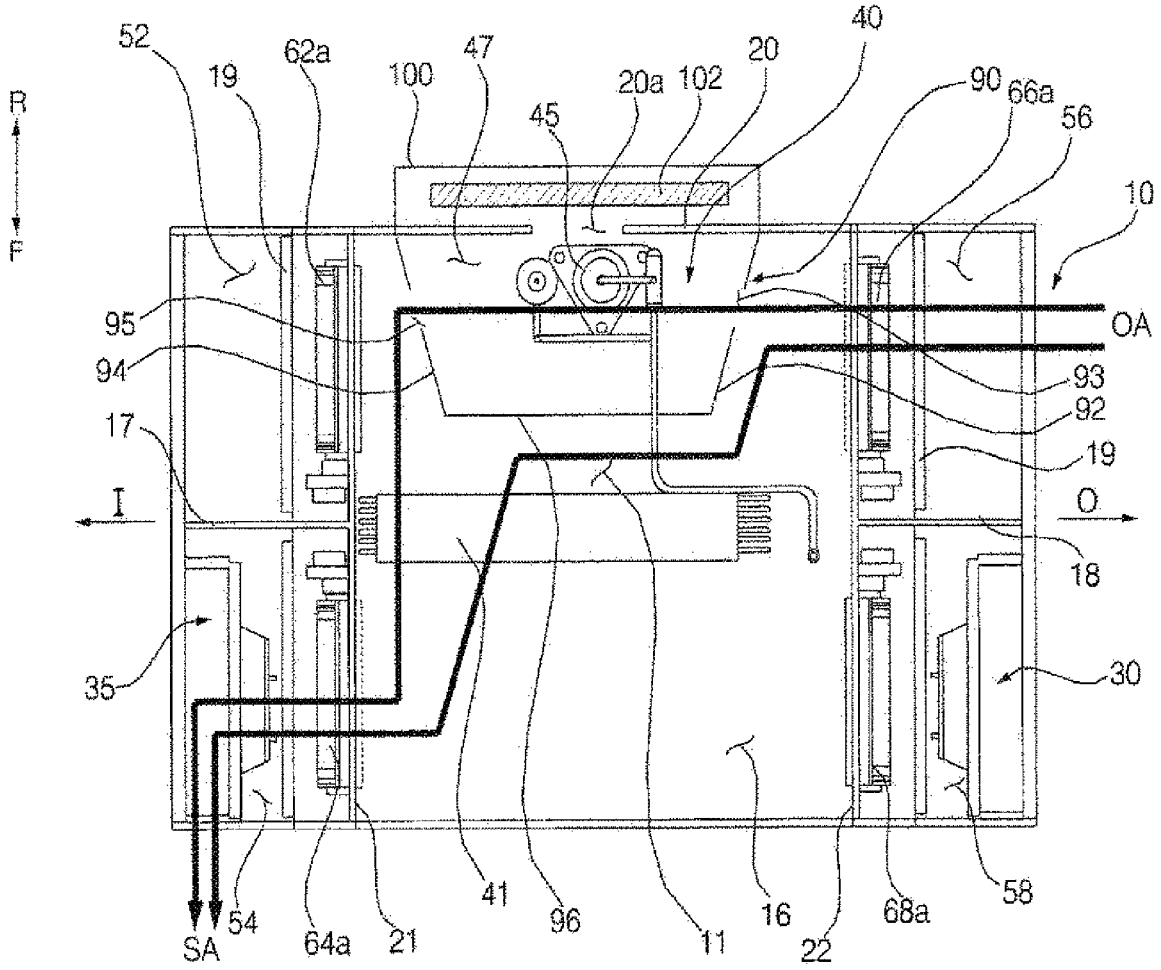
FIG. 6A is a diagram illustrating an airflow in the air conditioner shown in FIG. 2 in the case where an indoor discharge fan operates.
Figure 6B:
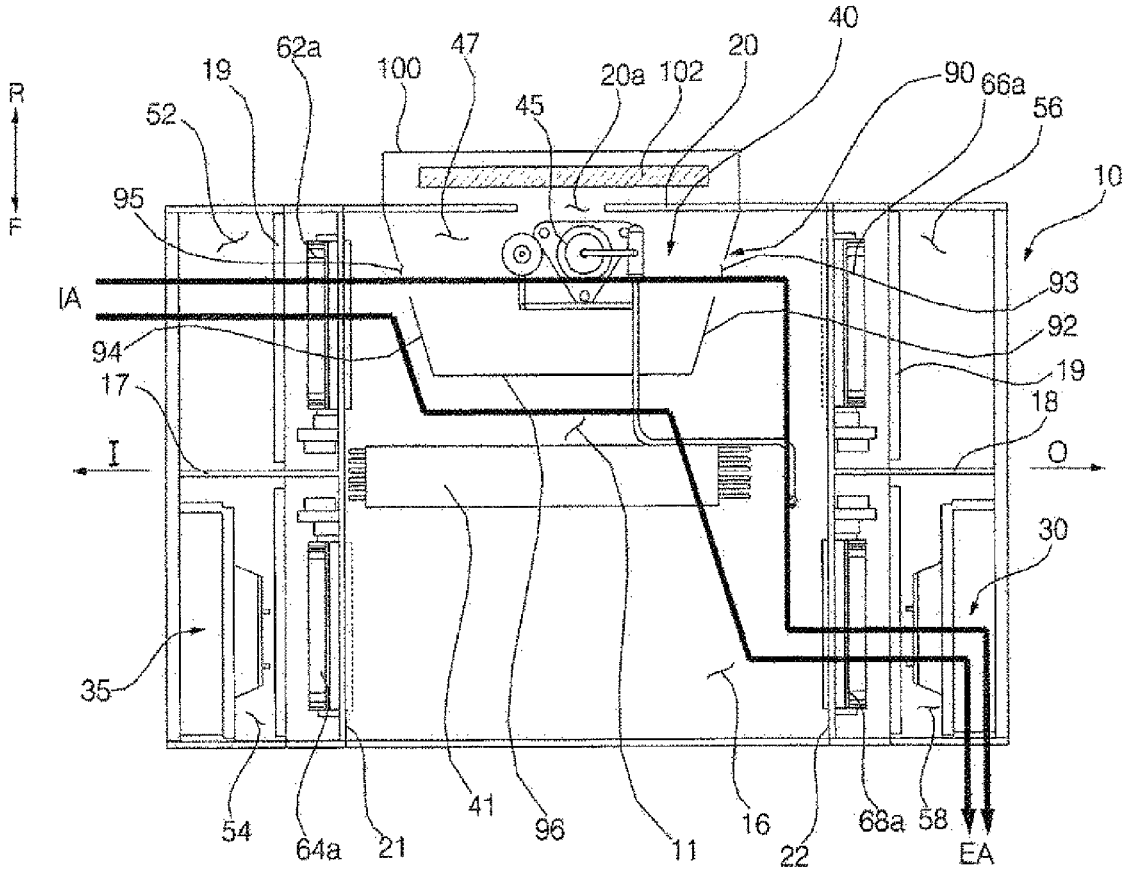
FIG. 6B is a diagram illustrating an airflow in the air conditioner shown in FIG. 2 in the case where an outdoor discharge fan operates.

In FIG. 6B, air intake (OA) into the outdoor suction chamber 56 is supplied (SA) to the indoor discharge chamber 54 through the first common passage 11. In addition, air ventilated (IA) to the indoor suction chamber 52 is exhausted (EA) to the outdoor discharge chamber 58 through the second common passage 12. In this case, in the first common passage 11, the first outdoor suction damper 66*a* and the first indoor discharge damper 64*a* are opened and the first outdoor discharge damper 64*b* and the first indoor suction damper 62*a* are closed. In addition, in the second common passage 12, the second indoor suction damper 62*b* and the second outdoor discharge damper 68*b* are opened and the second indoor discharge damper 64*b* and the second outdoor suction damper 66*b* are closed.

According to a type of an opened damper, the first common passage 11 may supply air into an indoor space by intaking (OA) outdoor air or may exhaust air to an outdoor space by ventilating (IA) indoor air. Similarly, according to a type of an opened damper, the second common passage 12 may also supply (SA) air into an indoor space by intaking (OA) indoor air or may exhaust (EA) air to an outdoor space by ventilating (IA) indoor air.

Figure 5B:
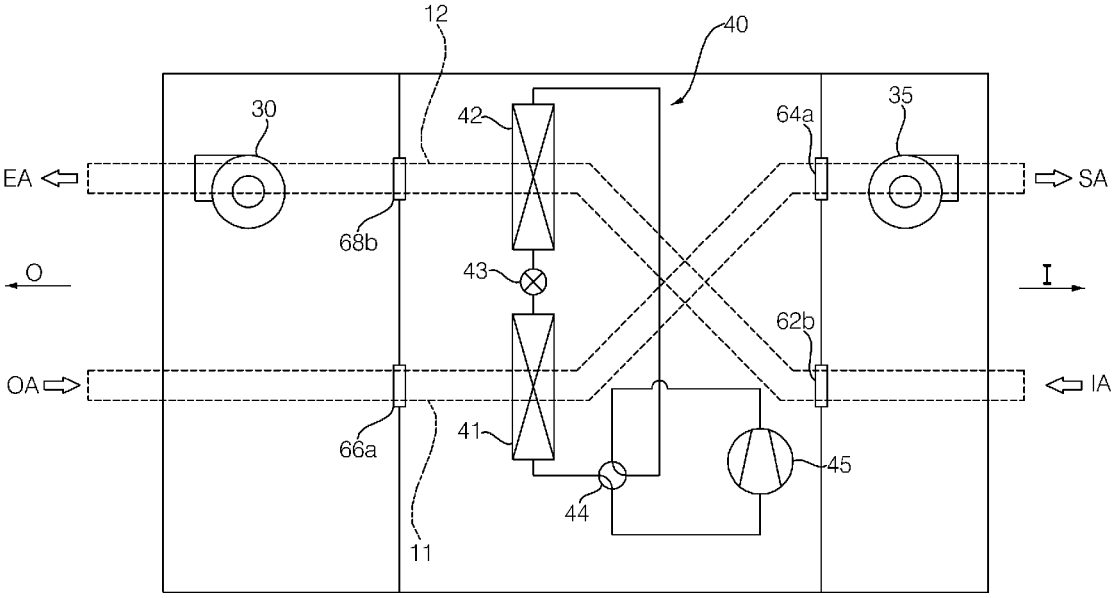
FIG. 5B is a schematic view of an airflow according to an operation method of an air conditioner apparatus according to another embodiment of the present invention.

In FIGS. 5A and 5B, the first common passage 11, the second common passage 12, the first desiccant heat exchanger 41, and the second desiccant heat exchanger 42 are located at different positions. However, it is merely to describe change in an airflow passing through the first common passage 11 or the second common passage 12 according to a type of an opened damper. Thus, it does not mean that the actual arrangement of the first common passage 11, the second common passage 12, the first desiccant heat exchanger 41, and the second desiccant heat exchanger 42 are changed.

A high-temperature and high-pressure refrigerant discharged from the compressor 45 may be switched by the refrigerant switching valve 44 to flow toward the first desiccant heat exchanger 41 provided in the first common passage 11 or toward the second desiccant heat exchanger 42 provided in the second common passage 12.

In the case of dehumidifying an indoor space, a desiccant heat exchanger arranged in a common passage through which air is exhausted (EA) to an outdoor space may act as a condenser which condenses a flown refrigerant. In addition, a desiccant heat exchanger arranged in the other common passage may act as an evaporator. Thus, air supplied (SA) to an indoor space passes through the desiccant heat exchanger which acts as an evaporator. As moisture of air flowing inside the desiccant heat exchanger operating as an evaporator is absorbed by the surface of the corresponding desiccant heat exchanger, the air supplied (SA) to the indoor space may become dried.

For example, in FIG. 5A, the second desiccant heat exchanger 42 arranged in the second common passage 12 for supplying (SA) air to an indoor space may act as an evaporator. In addition, the first desiccant heat exchanger 41 arranged in the first common passage 11 for exhausting (EA) air to an outdoor space may act as a condenser. In this case, the air supplied (SA) to the indoor space may pass through the second desiccant heat exchanger 42, and accordingly, the indoor space may become dehumidified.

In contrast, in the air flow shown in FIG. 5B, the first desiccant heat exchanger 41 arranged in the first common passage 11 for supplying (SA) air to an indoor space may act as an evaporator. In addition, the second desiccant heat exchanger 42 arranged in the second common passage 12 for exhausting (EA) air to an outdoor space may act as a condenser, and accordingly, the indoor space may become dehumidified.

In contrast, in the case of humidifying an indoor space, a desiccant heat exchanger arranged in a common passage through which air is exhausted to an outdoor space may act as an evaporator. In addition, a desiccant heat exchanger arranged in the other common passage may act as a condenser. Thus, as air supplied (SA) to the indoor space may pass through the desiccant heat exchanger which acts as a condenser, the desiccant heat exchanger supplies moisture to the flowing air to thereby humidify the air supplied (SA) to the indoor space.

For example, in FIG. 5A, the second desiccant heat exchanger 42 arranged in the second common passage 12 for supplying (SA) air to an indoor space may act as a condenser, and the first desiccant heat exchanger 41 arranged in the first common passage 11 for exhausting (EA) air to an outdoor space may act as an evaporator. As the air supplied (SA) to the indoor space passes through the second desiccant heat exchanger 42, the indoor space may become humidified.

FIG. 6 is a diagram illustrating flow of air moving in an air conditioner shown in FIG. 2.

In the following description, with reference to FIGS. 2 and 6, a structure of a suction guide according to an embodiment of the present invention, and air flow in a common passage will be described. The air flow in FIG. 6 is described as air flow in an area where the first common passage 11 is arranged as shown in FIG. 2, but it may be applicable even to an area where the second common passage 12 is arranged as shown in FIG. 3.

The suction guide 90 according to this embodiment is obliquely formed on a surface in which the indoor suction chamber 52 and the outdoor suction chamber 56 are opened. The suction guide 90 has a compressor accommodation chamber 47 formed therein, the compressor accommodation chamber 47 in which the compressor 45 is arranged.

The suction guide 90 according to this embodiment includes a first guide surface 92 which guides ventilated (IA) air to the indoor suction chamber 52, and a second guide surface 94 which guides intake (OA) air to the outdoor suction chamber 56. The suction guide 90 may further include a central guide surface 96 having one end connected to the first guide surface 92 and the other end connected to the second guide surface 94.

The compressor accommodation chamber 47 according to this embodiment is configured such that the central guide surface 96 is disposed forward of the compressor accommodation chamber 47, the first guide surface 92 and the second guide surface 94 are disposed leftward and rightward of the compressor accommodation chamber 47, and a rear surface 20 of the case 10 is disposed rearward of the compressor accommodation chamber 47.

In the suction guide 90 according to this embodiment, there are formed at least two cooling holes 93 and 95 for sending some of air flown into the case 10 to the compressor accommodation chamber 47 and for sending air flowing inside the compressor accommodation chamber 47 to the first common passage 11 or the second common passage 12.

Referring to FIG. 2, a first cooling hole 93 through which some of air flown into the indoor suction chamber 52 flows into the compressor accommodation chamber 47 is formed in the first guide surface 92 according to this embodiment. A second cooling hole 95 through which some of air flown into the outdoor suction chamber 56 flows to an inside of the compressor accommodation chamber 47 is formed in the second guide surface 94.

Air flown into the indoor suction chamber 52 or the outdoor suction chamber 56 flows to the desiccant heat exchanger 41 or 42 along the first guide surface 92 or the second guide surface 94. However, some of the air flown into the indoor suction chamber 52 or the outdoor suction chamber 56 may flow into the compressor accommodation chamber 47 through the cooling hole 93 or 95 respectively formed on the first guide surface 92 or the second guide surface 94. The air flown into the compressor accommodation chamber 47 cools the inside of the compressor accommodation chamber 47.

The air conditioner apparatus according to this embodiment includes a control device 102 for controlling operation of each component of the air conditioner apparatus, and a control box 100 for accommodating the control device. The control device 102 may be a device which includes a Printed Circuit Board (PCB) and which is electrically connected to the indoor discharge fan 35, the outdoor discharge fan 30, the compressor 45, and a plurality of dampers.

The control box 100 may be a box which accommodates the control box 102 to protect the same from an external environment. The control box 100 according to this embodiment is arranged at the rear of the case 10. The control box 100 according to this embodiment is arranged at the rear of a rear surface of the case 10. The control box 100 according to this embodiment is arranged at the rear of a space formed by the suction guide 90, the space in which the compressor 45 is accommodated.

In the rear surface 20 of the case 10 connected to the control box 100 according to this embodiment, there is formed a communication hole 20*a* which communicates the compressor accommodation chamber 47 and the inside of the control box 100 with each other. Air flown into the cooling hole 93 or 95 of the first guide surface 92 or the second guide surface 94 may flow into the inside of the control box 100 through the communication hole 20*a*.

Airflow in the air conditioner apparatus in FIG. 2 will be described with reference to FIGS. 6A and 6B.

Referring to FIG. 6A, some of the air flown into the indoor suction chamber 52 flows to the desiccant heat exchangers 41 and 42 along the first guide surface 92. However, the rest of the air flown into the indoor suction chamber 52 may flow into the compressor accommodation chamber 47 through the first cooling hole 93 formed in the first guide surface 92 and cool the inside of the compressor accommodation chamber 47. Air flowing inside the compressor accommodation chamber 47 is discharged to the suction side passage 15 through the second cooling hole 95 formed in the second guide surface 94. The air discharged from the compressor accommodation chamber 47 flows to the desiccant heat exchangers 41 and 42.

However, some of the air flowing inside the compressor accommodation chamber 47 may flow into the control box 100 through the communication hole 20*a* and cool the control device 102 disposed inside the control box 100.

Referring to FIG. 6, some of air flown into the outdoor suction chamber 56 flows to the desiccant heat exchangers 41 and 42 along the second guide surface 94. However, the rest of the air flown into the outdoor suction chamber 56 flows into the compressor accommodation chamber 47 through the second cooling hole 95 formed in the second guide surface 94. The air flowing inside the compressor accommodation chamber 47 cools the compressor 45. The air flowing inside the compressor accommodation chamber 47 is discharged to the suction side passage 15 through the first cooling hole 93 formed in the first guide surface 92. The air discharged from the compressor accommodation chamber 47 flows to the desiccant heat exchangers 41 and 42.

Similarly, some of the air flowing inside the compressor accommodation chamber 47 may flow into the control box 100 through the communication hole 20*a*. The air flowing inside the control box 100 may cool the control device 102 disposed inside the control box 100.

Figure 7:
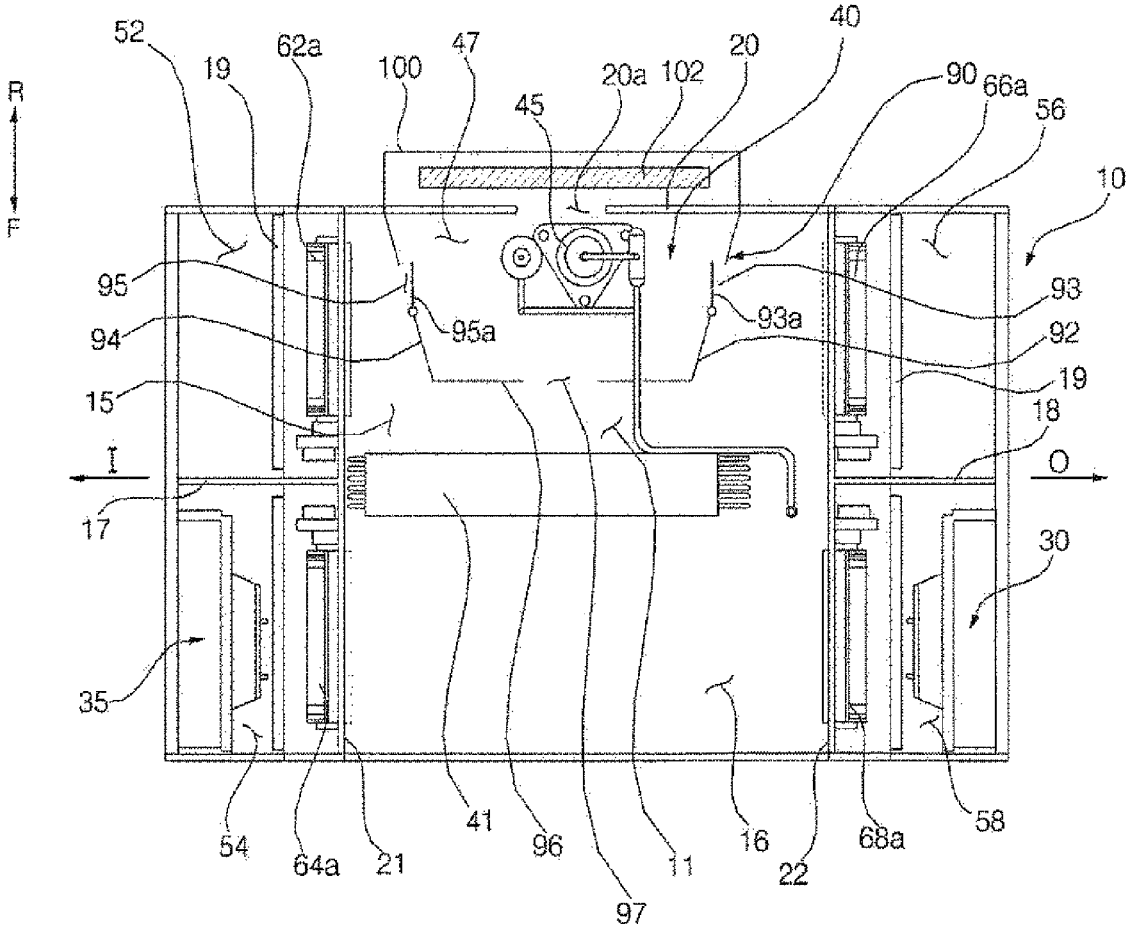
FIG. 7 is a diagram illustrating an air conditioner apparatus including a suction guide with a cooling hole formed therein according to another embodiment of the present invention.

FIG. 7 is a diagram illustrating an air conditioner apparatus including a suction guide with a cooling hole formed therein according to another embodiment of the present invention. FIG. 8 is a diagram illustrating airflow flowing in the air conditioner apparatus shown in FIG. 7.

Hereinafter, a structure of a suction guide and an airflow in a common passage according to an embodiment of the present invention will be described with reference to FIGS. 7 and 8. The airflow in FIG. 8 is described as an airflow in either the first common passage or the second common passage, but it may be applied to any other passage which is not described. The drawings of FIGS. 7 and 8 show an embodiment different from an embodiment of FIGS. 2 and 6, but elements having like functions are indicated by like reference numerals.

Referring to FIG. 7, an air conditioner apparatus according to this embodiment includes a suction guide 90 disposed in an outer circumference of a compressor accommodation chamber. The suction guide 90 includes a first guide surface 92, a second guide surface 94, and a central guide surface 96.

A control box 100 with a control device accommodated therein is disposed at the rear of the case 10. The control box 100 is disposed at the rear of a rear surface 20 of the case 10. In the rear surface 20 of the case 10, there is formed a communication hole 20*a* which communicates the inside of the control box 100 and the compressor accommodation chamber 47 with each other.

A first cooling hole 93 through which some of air flown into the indoor suction chamber 52 flows into the compressor accommodation chamber 47 is formed in the first guide surface 92. A second cooling hole 95 through which some of air flown into the outdoor suction chamber 56 flows into the compressor accommodation chamber 47 is formed in the second guide surface 94.

A first one-way valve 93*a* and a second one-way valve 95*a* for allowing air to flow in a one-way direction are disposed at the first cooling hole 93 and the second cooling hole 95, respectively. The first one-way valve 93*a* and the second one-way valve 95*a* move in a direction inward of the compressor accommodation chamber 47. Thus, at the first cooling hole 93 and the second cooling hole 95, air flows into the compressor accommodation chamber 47 by the first one-way valve 93*a* and the second one-way valve 95*a*.

The first one-way valve 93*a* and the second one-way valve 95*a* are hinge-fixed to one side of the first guide surface 92 and the second guide surface 94 to move in a direction inward of the compressor accommodation chamber 47. In the central guide surface 96, there is formed a discharge hole 97 through which air flown into the first cooling hole 93 or the second cooling hole 95 is discharged to the suction side passage 15.

Airflow in the air conditioner apparatus shown in FIG. 7 will be described with reference to FIGS. 8A and 8B.

Figure 8A:
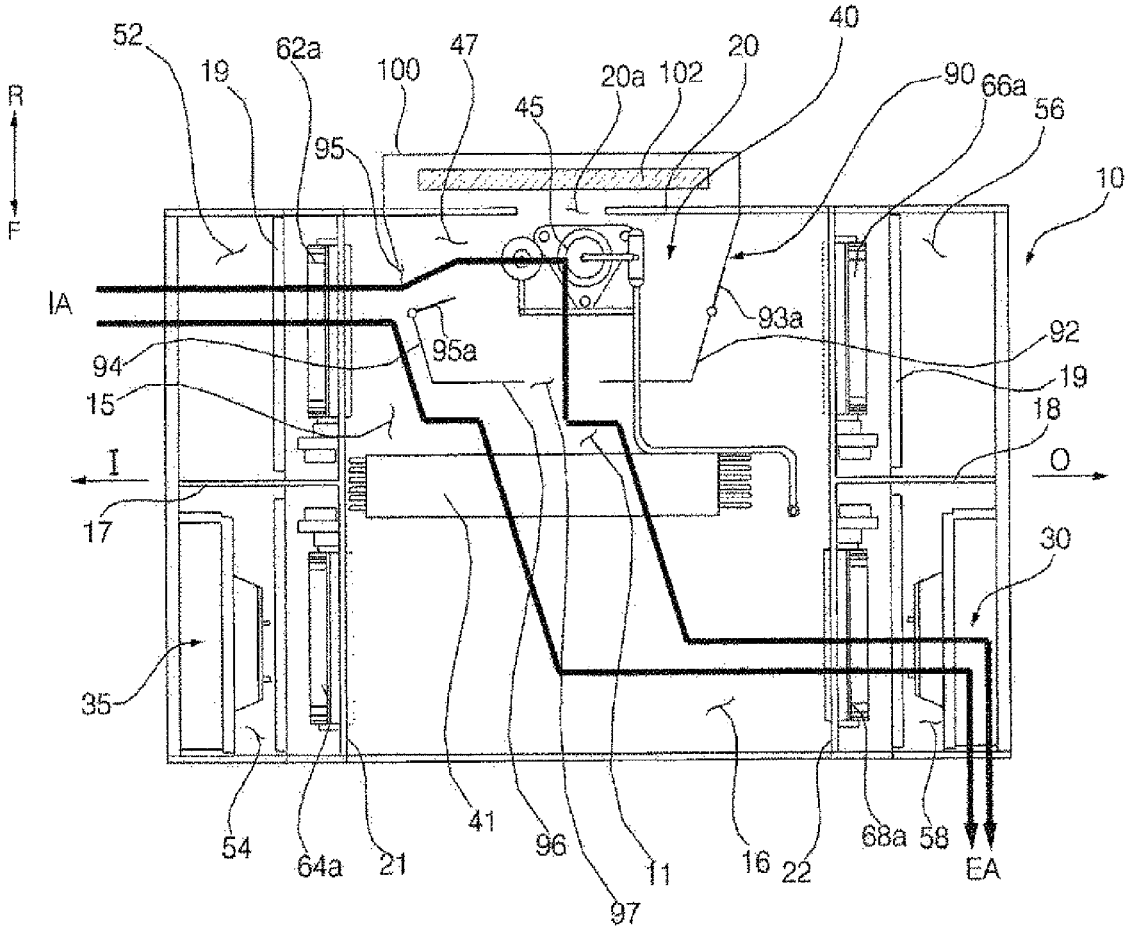
FIG. 8A is a diagram illustrating airflow flowing in the air conditioner apparatus shown in FIG. 7 in the case where an indoor discharge fan operates.

Referring to FIG. 8A, some of air flown into the indoor suction chamber 52 flows to the desiccant heat exchangers 41 and 42 along the first guide surface 92. However, the rest of the air flown into the indoor suction chamber 52 flows to the compressor accommodation chamber 47 through the first cooling hole 93 formed in the first guide surface 92 and cools the inside of the compressor accommodation chamber 47. The one-way valve 93*a* disposed at the first cooling hole 93 moves inward of the compressor accommodation chamber 47 by pressure of air suctioned into the indoor suction chamber 52, and, in turn, the first cooling hole 93 is opened. The air flowing inside the compressor accommodation chamber 47 is discharged to the suction side passage 15 through the discharge hole 97 formed in the central guide surface 96 and flows to the desiccant heat exchangers 41 and 42.

However, some of the air flowing inside the compressor accommodation chamber 47 may flow into the control box 100 through the communication hole 20*a* and cools the control device 102 disposed inside the control box 100.

Figure 8B:
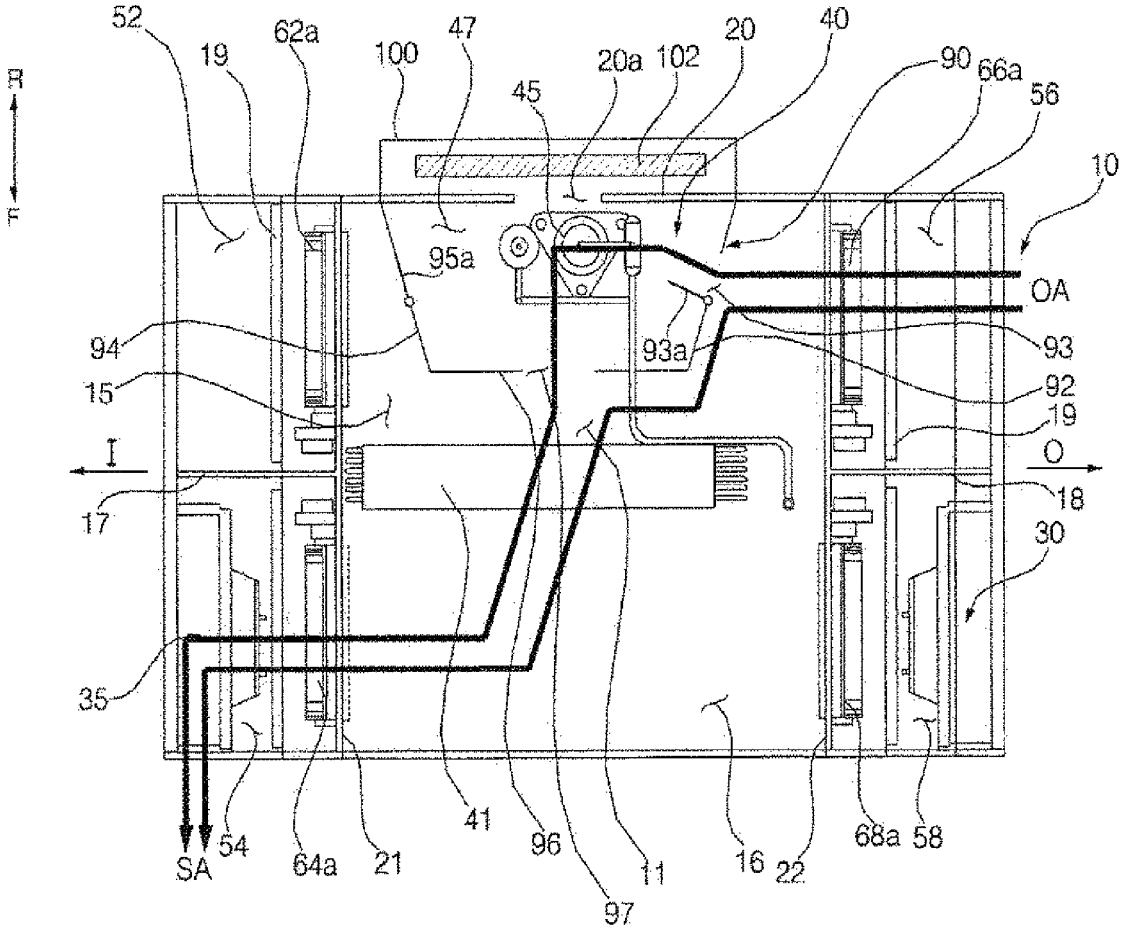
FIG. 8B is a diagram illustrating airflow flowing in the air conditioner apparatus shown in FIG. 7 in the case where an outdoor discharge fan operates.

Referring to FIG. 8B, some of the air flown into the outdoor suction chamber 56 flows into the desiccant heat exchangers 41 and 42 along the second guide surface 94. However, the rest of the air flown into the outdoor suction chamber 56 flows into the compressor accommodation chamber 47 through the second cooling hole 95 formed in the second guide surface 94 and cools the inside of the compressor accommodation chamber 47. The second one-way valve 95*a* disposed at the second cooling hole 95 moves inward of the compressor accommodation chamber 47 by pressure of air suctioned into the outdoor suction chamber 56, and, in turn, the second cooling hole 95*a* is opened. The air flowing inside the compressor accommodation chamber 47 is discharged to the suction side passage 15 through the discharge hole 97 formed in the central guide surface 96 and flows to the desiccant heat exchangers 41 and 42.

Some of the air flowing inside the compressor accommodation chamber 47 may flow into the control box 100 through the communication hole 20*a* and cool the control device 102 disposed inside the control box 100.

Although the exemplary embodiments have been illustrated and described, embodiments are not limited to the above-described particular embodiments, various modifications are possible by those skilled in the art without departing from the scope and spirit as disclosed in the accompanying claims and these modifications should not be understood separately from the scope and spirit.

The invention claimed is:

1. An air conditioner apparatus comprising:

a case which forms a first common passage, through which indoor air or outdoor air flows, and a second common passage, through which indoor air or outdoor air flows and which is positioned above the first common passage;

an indoor discharge fan which directs outdoor air to flow into an indoor space through the first common passage or the second common passage;

an outdoor discharge fan which directs indoor air to flow into an outdoor space through the first common passage or the second common passage;

a first desiccant heat exchanger which is disposed in the first common passage to humidify or dehumidify air flowing in the first common passage;

a second desiccant heat exchanger which is disposed in the second common passage to humidify or dehumidify air flowing in the second common passage;

a compressor that compresses a refrigerant flowing into the first desiccant heat exchanger or the second heat exchanger;

a suction guide which is disposed in each of the first common passage and the second common passage, which guides air flowing into the case to the first desiccant heat exchanger or the second desiccant heat exchanger, and which forms a compressor accommodation chamber in which the compressor is accommodated; and a control box which accommodates a control device, and which is disposed external to the case, wherein at least two cooling holes through which some of the air flowing into the case flows to the compressor accommodation chamber and through which air flowing inside of the compressor accommodation chamber flows to the first common passage or the second common passage are formed in the suction guide, wherein an inside of the case is provided with:

an indoor discharge chamber which is connected to the first common passage and the second common passage and through which air is discharged to the indoor space; and an outdoor discharge chamber which is connected to the first common passage and the second common passage and through which air is discharged to the outdoor space, wherein the indoor discharge fan is disposed in the indoor discharge chamber, and the outdoor discharge fan is disposed in the outdoor discharge chamber, wherein a communication hole is formed in one surface of the case, onto which the control box is disposed, so that air flowing inside the case flows into the control box, wherein the control box is disposed external to the case in which the compressor accommodation chamber is formed, and wherein the communication hole provides communication between the compressor accommodation chamber and an inside of the control box.

2. The air conditioner apparatus of claim 1, wherein an inside of the case is further provided with:

an indoor suction chamber which is connected to the first common passage and the second common passage, and into which indoor air is suctioned; and an outdoor suction chamber which is connected to the first common passage and the second common passage, and into which outdoor air is suctioned, and wherein the suction guide comprises:

a first guide surface which guides air suctioned into the indoor suction chamber, and in which a first cooling hole through which some of the air flows to the compressor accommodation chamber is formed; and a second guide surface which guides air suctioned into the outdoor suction chamber, and in which a second cooling hole through which some of the air flows to the compressor accommodation chamber is formed.

3. The air conditioner apparatus of claim 1, wherein a discharge hole through which air flowing into the compressor accommodation chamber flows to the first desiccant heat exchanger or the second desiccant heat exchanger is formed in the suction guide.

4. The air conditioner apparatus of claim 1, further comprising one-way valves which are disposed at the at least two cooling holes of the suction guide to control a flow direction of air communicating through the at least two cooling holes to be a one-way direction.

5. The air conditioner apparatus of claim 1, wherein an inside of the case is further provided with:

an indoor suction chamber which is connected to the first common passage and the second common passage, and into which indoor air is suctioned; and an outdoor suction chamber which is connected to the first common passage and the second common passage, and into which outdoor air is suctioned, and wherein the suction guide comprises:

a first guide surface which guides air suctioned into the indoor suction chamber, and in which a first cooling hole through which some of the air flows to the compressor accommodation chamber is formed;

a second guide surface which guides air suctioned into the outdoor suction chamber and in which a second cooling hole through which some of the air flows to the compressor accommodation chamber is formed; and a central guide surface which connects the first guide surface and the second guide surface, and in which a discharge hole through which air flowing into the compressor accommodation chamber flows to the desiccant heat exchangers is formed.

6. The air conditioner apparatus of claim 5, wherein a first one-way valve that controls air flowing through the first cooling hole to flow in a one-way direction is disposed in the first guide surface, and wherein a second one-way valve that controls air flowing through the second common passage to flow in a one-way direction is disposed in the second guide surface.

7. The air conditioner apparatus of claim 6, wherein the first one-way valve and the second one-way valve rotate inwardly toward the compressor accommodation chamber.

8. An air conditioner apparatus comprising:

a case which forms a first common passage, through which indoor air or outdoor air flows, and a second common passage, through which indoor air or outdoor air flows and which is positioned above the first common passage;

an indoor discharge fan which directs outdoor air to flow into an indoor space through the first common passage or the second common passage;

an outdoor discharge fan which directs indoor air to flow into an outdoor space through the first common passage or the second common passage;

a first desiccant heat exchanger which is disposed in the first common passage to humidify or dehumidify air flowing in the first common passage;

a second desiccant heat exchanger which is disposed in the second common passage to humidify or dehumidify air flowing in the second common passage;

a compressor that compresses a refrigerant flowing into the first desiccant heat exchanger or the second heat exchanger;

a suction guide which is disposed in each of the first common passage and the second common passage, which guides air flowing into the case to the first desiccant heat exchanger or the second desiccant heat exchanger, and which forms a compressor accommodation chamber in which the compressor is accommodated, wherein at least two cooling holes through which some of the air flowing into the case flows to the compressor accommodation chamber and through which air flowing inside of the compressor accommodation chamber flows to the first common passage or the second common passage are formed in the suction guide; and one-way valves which are disposed at the at least two cooling holes of the suction guide to control a flow direction of air communicating through the at least two cooling holes to be a one-way direction, wherein an inside of the case is provided with:

an indoor discharge chamber which is connected to the first common passage and the second common passage and through which air is discharged to the indoor space; and an outdoor discharge chamber which is connected to the first common passage and the second common passage and through which air is discharged to the outdoor space, and wherein the indoor discharge fan is disposed in the indoor discharge chamber, and the outdoor discharge fan is disposed in the outdoor discharge chamber.

9. An air conditioner apparatus comprising:

a case which forms a first common passage, through which indoor air or outdoor air flows, and a second common passage, through which indoor air or outdoor air flows and which is positioned above the first common passage;

an indoor discharge fan which directs outdoor air to flow into an indoor space through the first common passage or the second common passage;

an outdoor discharge fan which directs indoor air to flow into an outdoor space through the first common passage or the second common passage;

a first desiccant heat exchanger which is disposed in the first common passage to humidify or dehumidify air flowing in the first common passage;

a second desiccant heat exchanger which is disposed in the second common passage to humidify or dehumidify air flowing in the second common passage;

a compressor that compresses a refrigerant flowing into the first desiccant heat exchanger or the second heat exchanger; and a suction guide which is disposed in each of the first common passage and the second common passage, which guides air flowing into the case to the first desiccant heat exchanger or the second desiccant heat exchanger, and which forms a compressor accommodation chamber in which the compressor is accommodated, wherein at least two cooling holes through which some of the air flowing into the case flows to the compressor accommodation chamber and through which air flowing inside of the compressor accommodation chamber flows to the first common passage or the second common passage are formed in the suction guide, wherein an inside of the case is provided with:

an indoor discharge chamber which is connected to the first common passage and the second common passage and through which air is discharged to the indoor space;

an outdoor discharge chamber which is connected to the first common passage and the second common passage and through which air is discharged to the outdoor space, and wherein the indoor discharge fan is disposed in the indoor discharge chamber, and the outdoor discharge fan is disposed in the outdoor discharge chamber;

an indoor suction chamber which is connected to the first common passage and the second common passage, and into which indoor air is suctioned; and an outdoor suction chamber which is connected to the first common passage and the second common passage, and into which outdoor air is suctioned, and wherein the suction guide comprises:

a first guide surface which guides air suctioned into the indoor suction chamber, and in which a first cooling hole through which some of the air flows to the compressor accommodation chamber is formed;

a second guide surface which guides air suctioned into the outdoor suction chamber and in which a second cooling hole through which some of the air flows to the compressor accommodation chamber is formed; and a central guide surface which connects the first guide surface and the second guide surface, and in which a discharge hole through which air flowing into the compressor accommodation chamber flows to the desiccant heat exchangers is formed, wherein a first one-way valve that controls air flowing through the first cooling hole to flow in a one-way direction is disposed in the first guide surface, and wherein a second one-way valve that controls air flowing through the second common passage to flow in a one-way direction is disposed in the second guide surface.

10. The air conditioner apparatus of claim 9, wherein the first one-way valve and the second one-way valve rotate inwardly toward the compressor accommodation chamber.

* * * * *